US008474292B2

(12) United States Patent
Kolbe et al.

(10) Patent No.: US 8,474,292 B2
(45) Date of Patent: Jul. 2, 2013

(54) STRAIGHTENING A TUBE ON AN EXPANDER

(75) Inventors: Manfred Kolbe, Moenchengladbach (DE); Uwe Feldmann, Rommerskirchen (DE); Arno Topueth, Moenchengladbach (DE)

(73) Assignee: SMS Meer GmbH, Moenchengladbach (DE)

( * ) Notice: Subject to any disclaimer, the term of this patent is extended or adjusted under 35 U.S.C. 154(b) by 641 days.

(21) Appl. No.: 12/577,751

(22) Filed: Oct. 13, 2009

(65) Prior Publication Data

US 2010/0095736 A1 Apr. 22, 2010

(30) Foreign Application Priority Data

Oct. 16, 2008 (DE) ..... 10 2008 051 879
Nov. 26, 2008 (DE) ..... 10 2008 059 108

(51) Int. Cl.
*B21D 7/00* (2006.01)
*B21D 3/00* (2006.01)

(52) U.S. Cl.
USPC ..... 72/31.03; 72/31.04; 72/367.1; 72/369

(58) Field of Classification Search
USPC ..... 72/31.03, 31.04, 208, 209, 367.1, 72/369, 370.01, 370.04–370.06, 370.08, 72/316, 392, 393, 96, 97, 283
See application file for complete search history.

(56) References Cited

U.S. PATENT DOCUMENTS 7,159,435 B2 * 1/2007 Feldmann et al. ..... 72/316
7,654,122 B2 * 2/2010 Tsuyuguchi et al. ..... 72/98

FOREIGN PATENT DOCUMENTS

GB 1454299 11/1976

* cited by examiner

*Primary Examiner* — Debra Sullivan
(74) *Attorney, Agent, or Firm* — Andrew Wilford

(57) ABSTRACT

A tube extending along a tube axis is straightened by radially outwardly plastically deforming and expanding the tube by means of an expander mandrel and simultaneously bending the tube by applying radially inwardly directed forces to the tube at three points lying on a triangle. One of the points is level with the mandrel on one side of the tube and the other two points axially flank it in axially opposite directions and bear on the other side of the tube.

6 Claims, 3 Drawing Sheets

STRAIGHTENING A TUBE ON AN EXPANDER

FIELD OF THE INVENTION

The present invention relates to a method of and apparatus for straightening a tube. More particularly this invention concerns such a method used for a tube on an expander.

BACKGROUND OF THE INVENTION

A typical expander tool or mandrel has a tension rod and a pusher beam that extend axially into the tube to be straightened. Interengaging wedge jaws on the rod and beam can be shifted axially together to expand the mandrel and thereby radially outwardly deform the tube. The tube is straightened by exerting radial forces on it in regions deviating from an axial centerline.

During the manufacture of tubes made of plate first bent into a round split tube and then welded according to the UOE (U-shaped, O-shaped, Expanded) method, the compression molding method, the three-roller bending method, or the like, the tube material is subjected to very high thermal stresses during the continuous longitudinal seam welding. Such a tube manufactured in this manner normally deviates from a straight shape during the bending process and is subsequently warped during the welding step. Thus a separate straightening step must be carried out to produce the desired straight pipe. Such straightening is particularly required with small-diameter tubing, that is with a diameter less than about 20 inches and a wall thickness greater than about 15 mm.

Thus the tubes are straightened using expander heads or mandrels such as described in GB 1,454,299. The actual expander mandrel consists of a head whose side faces are formed by an array of wedge-shaped jaws spread by a frustoconical outer surface of a core of the head. Relative axial shifting of the jaws, typically braced by the beam, and the head, typically carried by the tension rod, spreads the jaws and expands the tube. In this manner, tubes having a length of up to 18 m are expanded and calibrated gradually.

During expansion of the tube, however, asymmetry (canting) is created at the expander. This has a limited straightening effect, particularly since the material plastically deforms during the expansion. The effect however is minimal and is reproducible in a limited manner only. Hence devices are used together with the expander mandrel that have straightening saddle blocks or rollers axially offset from the expander head or tool and bearing on the tube from the exterior. They apply a radial force to the tube and bend the tube to straighten it by the effect of the expander mandrel. This process, however, applies torque to the pusher beam and tension rod that connect the expander mandrel to an actuator that shifts the mandrel axially along the tube. This has a negative effect on the service life of the components of the expander. Adding to the problem is the fact that the pusher beam, which is particularly thin at smaller diameters, acts as a soft spring, which has an adverse effect on the straightening result.

OBJECTS OF THE INVENTION

It is therefore an object of the present invention to provide an improved straightening system for a tube on an expander.

Another object is the provision of such an improved straightening system for a tube on an expander that overcomes the above-given disadvantages, in particular that does not have the disadvantages described above, particularly for the straightening of tubes having thick walls, high material strength, and small diameters.

SUMMARY OF THE INVENTION

A tube extending along a tube axis is straightened by radially outwardly plastically deforming and expanding the tube by means of an expander mandrel and simultaneously bending the tube by applying radially inwardly directed forces to the tube at three points lying on a triangle.

By functionally separating the expanding and straightening according to the invention asymmetries at the expander mandrel and at the pusher beam thereof, as well as the torques occurring at the tension rod, can be avoided. In this manner the service life of the components is not adversely affected. Furthermore, the straightening force may be introduced at exact locations in a controlled manner such that a tube can be straightened in a targeted and reproducible manner.

The device may be embodied such that straightening takes place either in one plane only (since the tube is often positioned over the welded seam in a hollow manner), or in three dimensions.

If, preferably straightening force means are applied by three straightening elements spaced axially along the tube, the straightening forces can still be generated by only one actuator, e.g. utilizing the application of force only at one point along the tube. The application of the straightening force at this one point while still gripping the tube at two other points forming the straightening triangle according to the invention.

According to one embodiment of the invention the straightness of the tube is measured, and the straightening process is corrected depending on the measurement results. This may occur either manually, or at least partially automatically.

The object of the invention is also attained by an apparatus according to the invention in that three straightening elements that are at an axial spacing from one another are associated with the expander mandrel. The center straightening element is provided in the region of the expander mandrel. This way no torque is applied to the mandrel by bending the tube, and the bending is focused at the softened area being plastically deformed by the mandrel.

According to one recommendation of the invention the straightening elements may be saddle blocks or rollers bearing on to the tube with the center straightening element also holding the tube, together with the expander mandrel inside the tube.

One embodiment of the invention provides that the rollers or saddle blocks are arranged in pairs opposite each other in frames with the rollers or saddle blocks of only the two exterior frames can preferably be engaged against the tube for applying the straightening force. Thus even though there are six such elements, only three of them are effective at any one time.

If the frames are connected to each other, the forces may be balanced, and are not transmitted to the base or the expander frame.

According to another embodiment of the invention a common support frame carries a center saddle block or roller, and a pair of outer saddle blocks or rollers flanking the center block or roller and on an opposite side of the tube at the outer ends of the support frame. The saddle blocks or rollers are preferably pivotal in the support frame. The tube is thus tensioned in such matter by the three straightening elements in one plane at three locations and is thus subjected to the influence of the straightening triangle formed by the two outer straightening elements on side and the center element on the other.

This may be achieved advantageously, if only one of the three saddle blocks or one of the rollers is operated by the actuator, such as a hydraulic cylinder, preferably one of the outer saddle blocks or one of the outer rollers.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
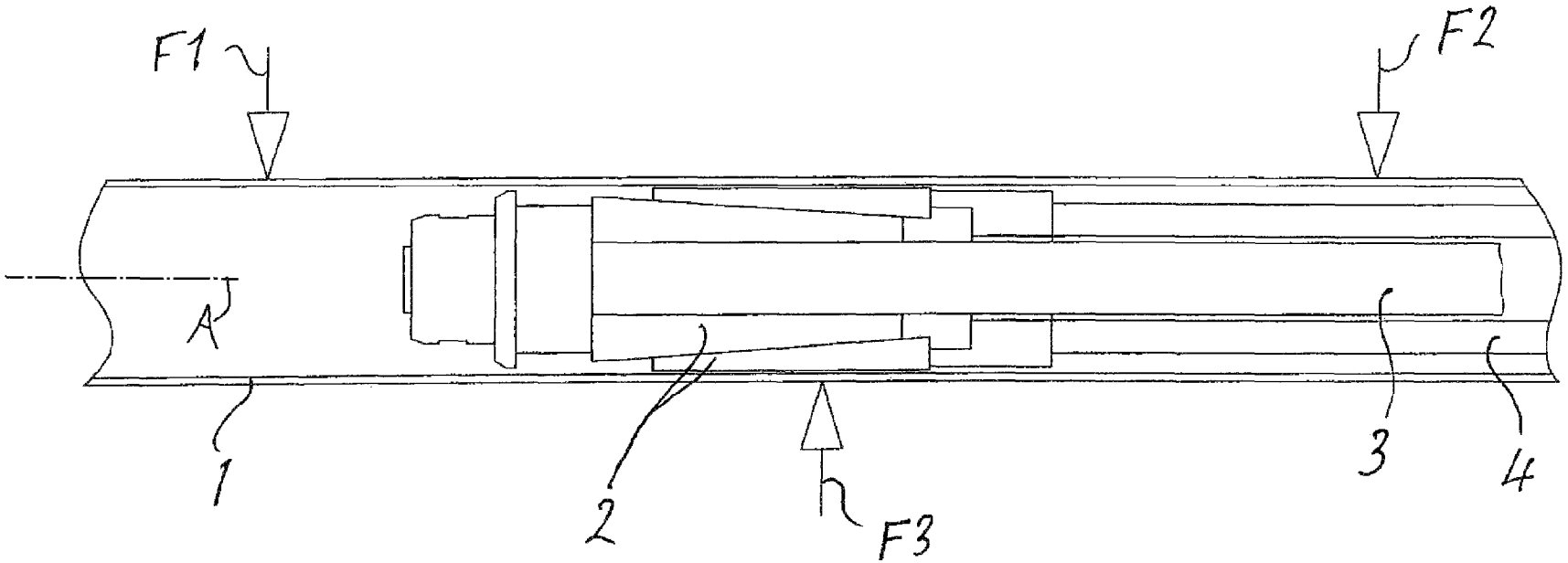
FIG. 1 is a schematic axial section through an expander mandrel being shifted through a tube with straightening forces being applied externally in a triangular pattern to the tube.
Figure 2:
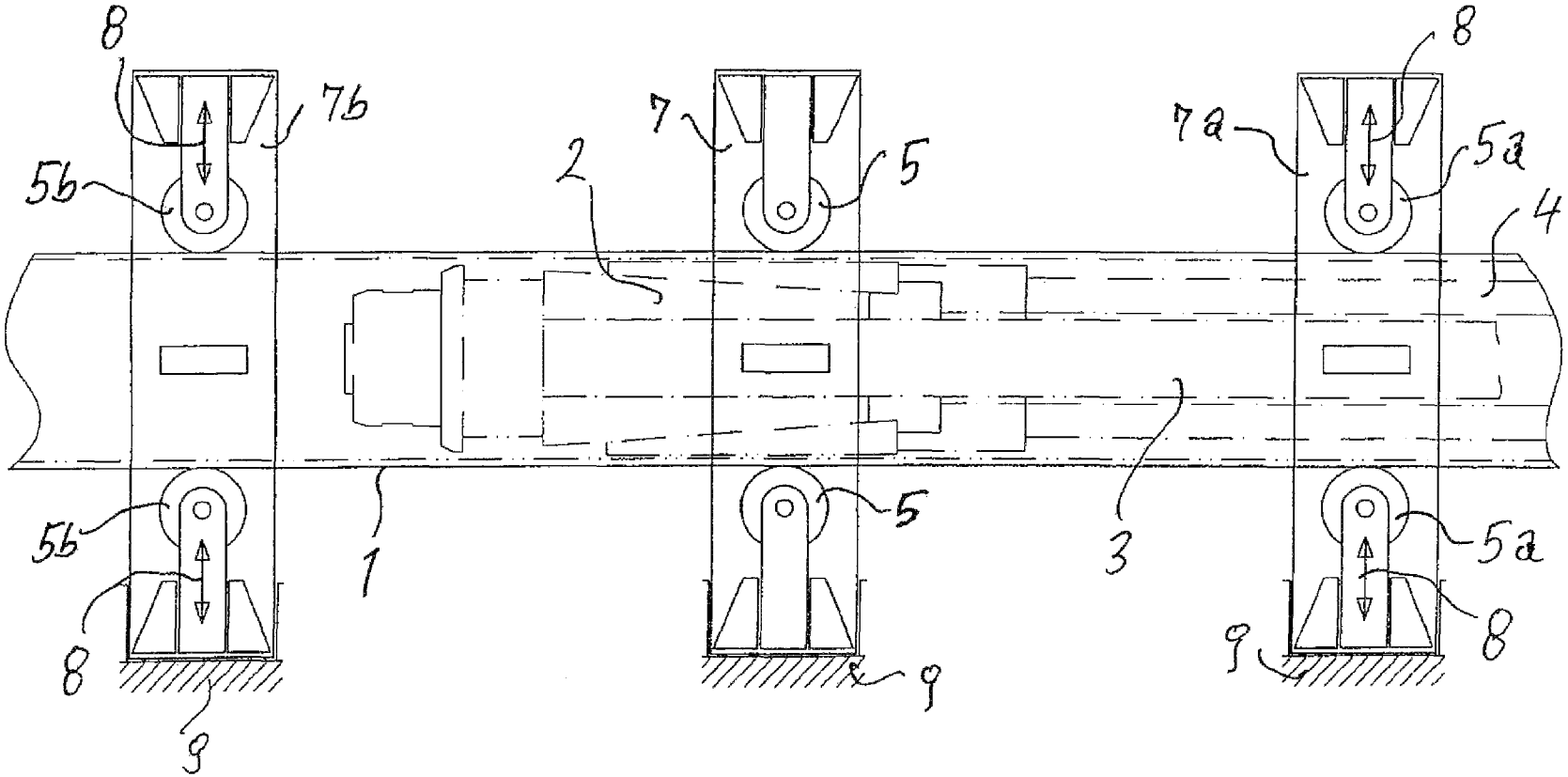
FIG. 2 is a similar view but with three of frames each carrying a pair of straighteners.
Figure 3:
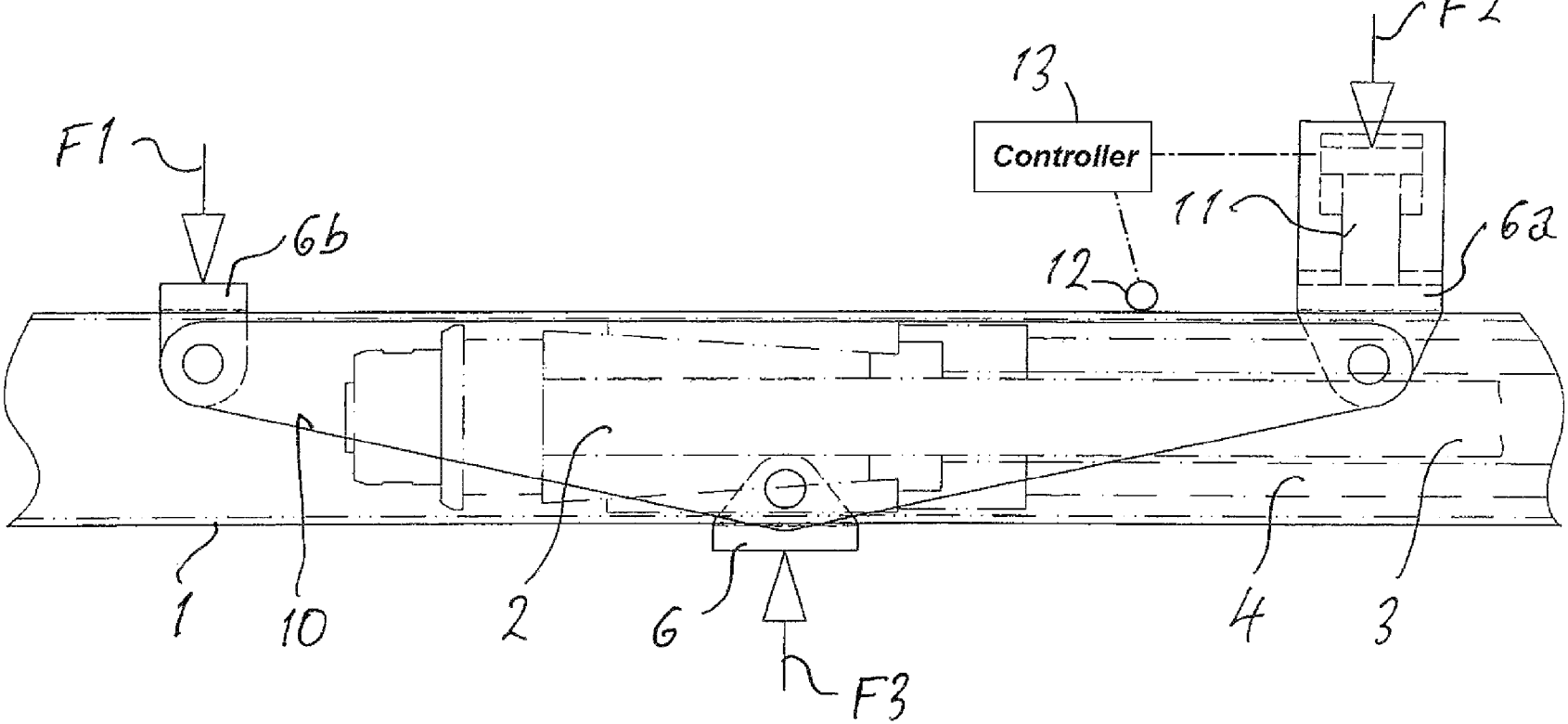
FIG. 3 is another such view with a common frame carrying three straighteners.

As seen in FIGS. 1 to 3, an expander mandrel 2 is shifted parallel to an axis of a thick-walled tube 1. The expander mandrel 2 is carried on an end of a tension rod 3 coaxially surrounded by a tubular pusher beam 4. The diameter of the expander mandrel 2 may be changed by relative axial shifting of its wedge parts as is well known in the art. When it is radially expanded it radially also stretches the tube 1 to plastically deform it, which action substantially reduces any force needed to bend and straighten the tube 1.

Separately from this radial expansion and plastic deformation and having no effect on it, straightening forces F1, F2, and F3 are applied at points forming a triangle from the exterior as shown by arrows. These forces are applied to straighten the tube 1. The straightening forces F1 to F3 may be applied to the tube 1 by means such as rollers 5, 5*a*, or 5*b*, or by means of saddle blocks 6, 6*a*, or 6*b*.

In the embodiment according to FIG. 2, the rollers 5, 5*a*, or 5*b* are positioned in pairs opposite of each other in three frames 7, 7*a*, or 7*b* spaced axially apart. The center frame 7 is level with the expander mandrel 2 and holds it in position together with the tube 1. In contrast, the rollers 5*a*, 5*b* of the two outer frames 7*a*, 7*b* can be engaged against the tube 1 by means of respective actuators 8 as indicated by double arrows. The right outer frame 7*a* is positioned downstream, and the left outer frame 7*b* is positioned upstream of the expander mandrel 2 relative to a tube-travel direction relative to the mandrel 2. If the frames 7, 7*a*, 7*b* are connected to each other (not illustrated in FIG. 2), the straightening forces F1 and F3 are balanced and not transmitted to a base 9 they are mounted on.

The embodiment according to FIG. 3 has a common triangular support frame 10 in which the saddle blocks 6, 6*a*, and 6*b* are pivoted. The straightening triangle formed by the straightening forces F1, F2, and F3 (see FIG. 1) is here created at one position actuated by a single actuator 11 mounted at the downstream outer saddle 6*a*. Here a sensor 12 is shown for detecting straightness of the tube workpiece 1. A controller 13 is connected to the sensor 12 and to the actuator 11 for operating the latter in accordance with an output from the former.

In any case only the straightening work for producing the straightness of the tube 1 is carried out by the elements forming the straightening triangle of the straightening forces F1 to F3, while the expander mandrel 2 only expands the tube 1, and carries out no straightening work itself. Since the force is applied at three points that here are axially offset from the mandrel 2, no twisting action or torque is applied to this mandrel so that its job of plastically deforming the tube and thereby making it more bendable for straightening purposes is not affected by the actual straightening operation.

We claim:

1. An apparatus for straightening a tubes extending along a tube axis, the apparatus comprising:

a radially expandable mandrel;

means for relatively axially shifting the mandrel and the tube while expanding the mandrel to radially expand and plastically deform the tube at the mandrel;

two outer straightening elements bearing radially inward against the tube at respective outer points thereon axially spaced from and flanking the mandrel and radially substantially nonmovable relative to the mandrel;

a central element bearing radially inward on the tube at a central point axially level with the mandrel and between the outer points;

a common frame carrying all of the straightening elements; and means for radially inwardly shifting one of the straightening elements on the frame relative to the other two straightening elements so as to apply radially directed bending forces to the tube and thereby straighten a section of the tube lying between the outer points.

2. The tube-straightening apparatus defined in claim 1 wherein the straightening elements are rollers bearing radially inward on the tube at the respective points.

3. The tube-straightening apparatus defined in claim 1 wherein the straightening elements are saddle blocks bearing radially inward on the tube at the respective points.

4. The tube-straightening apparatus defined in claim 1 wherein there are six such elements bearing radially inward on the tube and arrayed in axially confronting pairs spaced axially along the tube.

5. The tube-straightening apparatus defined in claim 4 wherein the means includes three frames each carrying a respective one of the pairs of the elements.

6. The tube-straightening apparatus defined in claim 1 wherein the elements are saddle blocks pivoted on the frame.

* * * * *